US009428907B2

(12) United States Patent
Gupta

(10) Patent No.: US 9,428,907 B2
(45) Date of Patent: Aug. 30, 2016

(54) FREE-STANDING CONTINUOUS WALL ASSEMBLY

(71) Applicant: Anil K Gupta, Pittsburgh, PA (US)

(72) Inventor: Anil K Gupta, Pittsburgh, PA (US)

( * ) Notice: Subject to any disclaimer, the term of this patent is extended or adjusted under 35 U.S.C. 154(b) by 0 days.

(21) Appl. No.: 14/591,219

(22) Filed: Jan. 7, 2015

(65) Prior Publication Data

US 2016/0194871 A1 Jul. 7, 2016

(51) Int. Cl.
*E04B 2/74* (2006.01)

(52) U.S. Cl.
CPC ..... *E04B 2/7433* (2013.01); *E04B 2/7438* (2013.01); *E04B 2002/7446* (2013.01); *E04B 2002/7477* (2013.01)

(58) Field of Classification Search
CPC ..... E04B 2/7433; E04B 2/7438; E04B 2002/7446; E04B 2002/7477
See application file for complete search history.

(56) References Cited

U.S. PATENT DOCUMENTS 1,871,913 A * 8/1932 Patterson ..... 52/280
2,076,472 A * 4/1937 London ..... 52/279
2,855,037 A * 10/1958 Stiffel ..... F16B 12/02 15/268
2,962,132 A * 11/1960 Reinhardt ..... E04B 2/7422 16/19
3,054,481 A * 9/1962 Johnson ..... E04B 1/24 52/262
3,326,505 A * 6/1967 Jamar, Jr. ..... E04B 2/7425 211/189
3,383,821 A * 5/1968 Gatch ..... 52/653.1
3,589,083 A * 6/1971 Scalfani, Jr. ..... E04F 13/0803 439/110
3,605,851 A * 9/1971 Miles ..... E04B 2/74 160/135
3,698,419 A * 10/1972 Tura ..... 137/318
3,713,257 A 1/1973 Beavers
3,722,928 A * 3/1973 Skubic ..... E04B 2/7433 217/43 A
3,730,477 A * 5/1973 Wavrunek ..... 248/243
4,323,163 A 4/1982 Johns
4,441,300 A * 4/1984 Varon et al. ..... 52/481.2
4,607,753 A 8/1986 Radek
4,805,783 A 2/1989 Mayer
4,958,671 A * 9/1990 Bove ..... 160/135
4,961,295 A 10/1990 Kosch, Sr. et al.
5,375,641 A 12/1994 Schlueter
5,460,353 A * 10/1995 Rittenhouse ..... A63B 1/028 160/135
5,718,092 A * 2/1998 Corston ..... B25B 27/0092 156/71
6,164,467 A 12/2000 DePottey et al.
6,336,298 B1 * 1/2002 Chou ..... 52/238.1
6,481,169 B1 * 11/2002 Ludwig ..... E04B 2/7453 160/351
7,014,253 B2 * 3/2006 Oren ..... 296/186.1
7,198,159 B2 4/2007 Fischer
2003/0209701 A1 * 11/2003 Goddard ..... E04H 17/20 256/47

* cited by examiner

*Primary Examiner* — Jeanette E Chapman
(74) *Attorney, Agent, or Firm* — James Ray & Assoc.

(57) ABSTRACT

A free-standing continuous wall assembly includes two end members, one or more intermediate members, a plurality of panels disposed in a vertical plane, each panel defining a one-piece sheet being sufficiently flexible to develop a concave shape when being supported in a horizontal plane at a pair of opposite edges thereof, and fasteners fastening each panel directly to one of the two end members and one intermediate member or directly to two intermediate members. The panel may be provided as a one-piece sheet that may be one of a peg board, slat board, chalk board, cork board and dry-erase board and any combination thereof.

18 Claims, 5 Drawing Sheets

FREE-STANDING CONTINUOUS WALL ASSEMBLY

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

1. Technical Field

The subject matter relates to free-standing walls. It further relates to free-standing continuous wall assemblies that may be used for display, storage and/or advertising purposes.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Peg board and slatwall type panels may be commonly used for display, storage and/or advertising purposes in various exposition, tradeshow, retail and residential settings. Panels with a magnetic type surface can be also used for display purposes. Panels with dry-erase surface may be used for communicating ideas, calendaring events, etc. Pegboard, dry-erase and magnetic type panels are generally secured to the fixed interior walls. Slatwall type panels may be also secured to the existing fixed interior walls. Slatwall type panels may be also provided as free-standing walls to display articles of merchandise which are for sale. A typical slatwall panel generally includes plurality of extrusions or slats that are disposed horizontally and that are linked together to define a unitary panel having a plurality of horizontally disposed slots. Opposite ends of each slat are interlocked with the end upright supports. Intermediate upright supports may be also used. However, such slatwall panel construction is characterized by a greater than desired material costs and/or labor costs to erect, take down and/or transport.

Generally, due to difference in mounting requirements, same type panels are used in assemblies for display, storage and/or advertising purposes. This may be disadvantageous in some applications requiring different type of panels to be combined into one assembly, particularly of a free-standing continuous wall type.

Therefore, there is a need for a free-standing continuous wall that may be composed of different type panels, is economical to manufacture and cost effective to assemble, dis-assemble and transport.

DETAILED DESCRIPTION OF EXEMPLARY EMBODIMENTS

Figure 1:
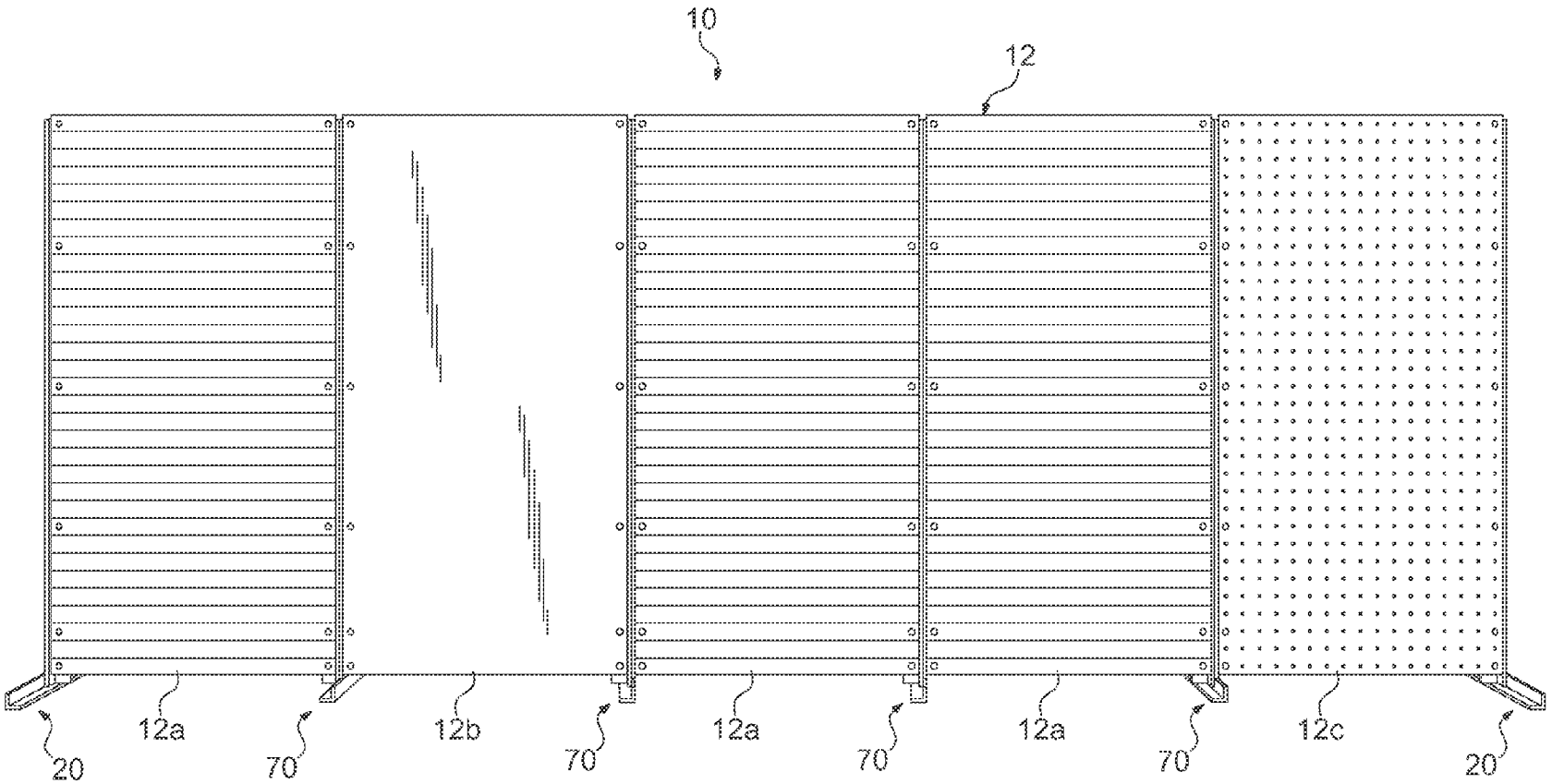
FIG. 1 illustrates an exemplary front perspective view of a free-standing continuous wall assembly.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in the Figures. Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, any specific dimensions and other physical characteristics relating to the examples disclosed herein are not to be considered as limiting, unless the claims expressly state otherwise.

The particular embodiments of the present disclosure generally provide assembly and methods directed to free-standing continuous wall assembly. In particular embodiments, the free-standing continuous wall assembly may be used for display, storage and/or advertising purposes and include two or more panels. In particular embodiments, the free-standing continuous wall assembly may be of a slatwall panel type. In particular embodiments, the free-standing continuous wall assembly may include panels of different types.

In particular embodiments, the components of the free-standing continuous wall assembly may be partially disassembled for storage and/or transport. A free-standing continuous wall assembly 10 comprises a plurality (two or more) of panels 12 disposed in a vertical plane during use of the free-standing continuous wall assembly 10, two end members 20 essentially being upright, one or more intermediate members 70 also essentially being upright, and fasteners fastening ends of each panel 12 directly to one of the two end members 20 and one intermediate member 70 or directly to two intermediate members 70.

Each of the plurality of panels 12 may define a one-piece continuous sheet having a uniform thickness throughout except for portions thereof occupied by at least one of apertures, channels, grooves and any combinations thereof. The thickness of each panel 12 may be any one of 0.13 inch, 0.25 inch, 0.375 inch, 0.5 inch, 0.63 inch, 0.75 inch and 1.00 inch.

Each panel 12 may be provided as any one of a 4 foot×8 foot sheet, a 4 foot×10 foot sheet, a 5 foot×8 foot sheet, and a 5 foot×10 foot sheet.

The one-piece continuous sheet may be one of a peg board, slat board, chalk board, cork board, magnetic board, dry-erase board and any combination thereof.

When each of the plurality of panels 12 is provided as a one-piece continuous sheet, such one-piece continuous sheet can be sufficiently flexible to develop a concave shape when being supported in a horizontal plane at a pair of opposite edges thereof. However, during use, when attached vertically to the end member 20 and/or intermediate members 70, each of the plurality of panels 12 is prevented, by a combination of the end and intermediate members, 20 and 70 respectively, and attachment of the panels 12 thereto, from developing such concave shape and may be further prevented from tilting in a forward or a rearward direction when weight is attached to a front surface 14 thereof.

Each panel 12 has holes 16 formed through a thickness thereof adjacent each vertical edge 18 of the panel 12. Each panel 12 may have only two holes 16, each positioned adjacent a top and bottom edge of the panel 12. Each panel 12 may have more than two holes 16 being disposed in a linear or a non-linear pattern adjacent each vertical edge 18.

Each hole 16 may have any one of a round shape, an elongated shape, a non-round shape and any combination thereof Each end member 20 includes a base portion 22, an upright portion 40 upstanding on the base portion 22 mediate ends 24 and 26 thereof and a brace 60 having one end 62 connected to the base portion 22 and having an opposite end 64 thereof connected to the upright portion 40.

Figure 4:
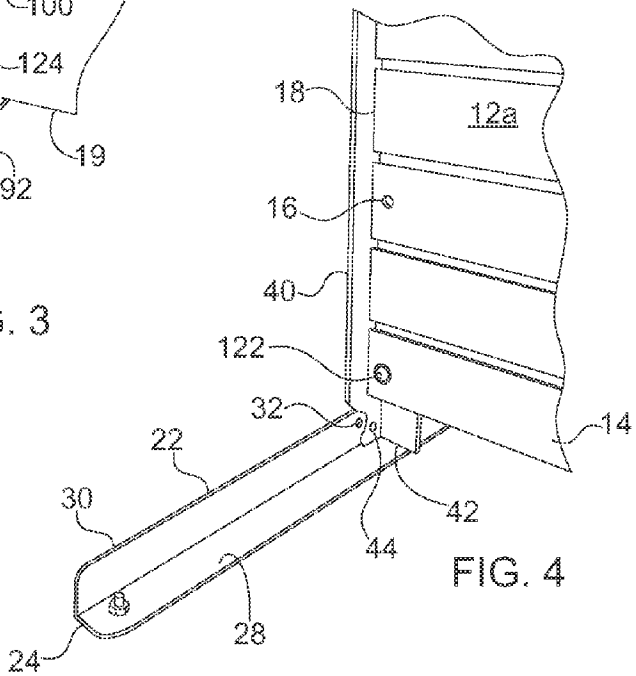
FIG. 4 illustrates a partial rear perspective view of a base portion of an end member of the free-standing continuous wall assembly of FIGS. 1-2.

The base portion 22 may have any cross-section in a plane normal to a length thereof including, without limitations, solid, closed hollow, for example such as a tubular shape or partially open, for example such as U-shape or L-shape of FIG. 4. The exemplary base portion 22 of FIG. 4 has a pair of flanges, a horizontally disposed flange, referenced with a numeral 28, and a vertically disposed flange, referenced with a numeral 30, defining, in a combination with each other, the above referenced L-shaped cross-section. The base portion 22 interfaces with the surface (not shown) that the free-standing continuous wall assembly 10 upstands on and may also include conventional feet/levelers.

Now in reference to FIG. 4, the upright portion 40 has a bottom end 42 being connected and fastened to the vertically disposed flange 30. Such bottom end 42 may be connected in a permanent manner, for example such as by welding, or in a releaseable manner, for example such as by fastening. When the connection is by way of fastening, the bottom end 42 is adapted with one or more apertures 44 and the flange 30 is adapted with one or more apertures 32 being aligned with one or more apertures 44 during assembly of the free-standing continuous wall assembly 10. The longitudinally opposite end 46 of the upright portion 40 may be provided as a free end. The upright portion 40 also has a flange 48. When a connection between the upright portion 40 and the panel 12 is by way of fastening, the flange 48 is adapted with two or more holes 50 formed through a thickness thereof and being positioned in a complimentary alignment with the two or more holes 16 in the panel 12. The flange 48 does not have to be continuous along the length of the upright portion 40. By way of an example only, the upright portion 40 may be provided as a tubular member (not shown) and the flange 48 may be defined by a plurality of tabs extending from an exterior surface of such tubular member and adapted with such hole 50.

Each brace 60 defines a pair of ends 62, 64 and a main portion 66 disposed between the pair of ends 62, 64. The main portion 66 may have, by way of one example only, an L-shaped cross-section in a plane transverse to a length thereof. One or both ends 62 and 64 may be flattened, each defining a pair of planar surfaces. When one or both ends 62 and 64 are flattened, each of the pair of flattened ends 62, 64 is inclined at an angle relative to the main portion 66. The brace 60 may be permanently or releaseably attached to the base portion 22 and upright portion 40 meaning that one end of the brace 60, referenced with numeral 62, is connected permanently or releaseably, for example by fastening, during use, to the horizontally disposed flange 28 and that the opposite end 64 of the brace is connected, permanently or releaseably, for example by fastening, to the upright portion 40.

When the brace 60 is adapted for a releaseable attachment, such attachment may be by way of fastening, wherein each of the pair of flattened ends 62, 64 has one or more apertures 68 formed through a thickness thereof and wherein complimentary apertures are provided in the base portion 22 and the upright portion 40.

When the connection is by way of fastening, each end 62, 64 is adapted with one or more apertures 68, the flange 28 is adapted with one or more apertures being aligned with one or more apertures 68 and upright portion 40 is adapted with one or more apertures.

The length of the brace 60 may be so selected that aperture 68 in the end 64 is aligned with the above described holes 16 and 50.

The opposite end 64 may be connected at a distance from the base portion 22 of between forty and sixty percent of a length of the upright portion 40, particular when the panel 12 is provided having a width of about four (4) feet) and a length of about eight (8) feet oriented in a vertical direction.

Each intermediate member 70 includes a base portion 72, an upright portion 90 upstanding on the base portion 72 mediate ends 74 and 76 thereof and a brace 110 having one end 112 connected to the base portion 72 and having an opposite end 114 thereof connected to the upright portion 90. The base portion 72 may be identical to the base portion 22.

Figure 5:
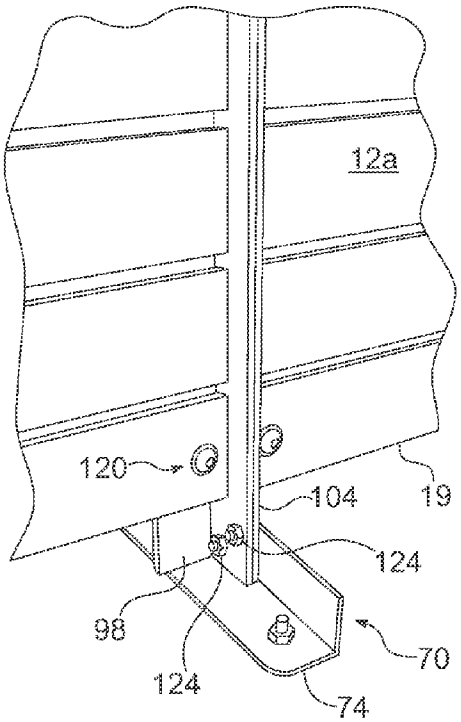
FIG. 5 illustrates a partial front perspective view of a base portion of the rear member of the free-standing continuous wall assembly of FIGS. 1-2.
Figure 3:
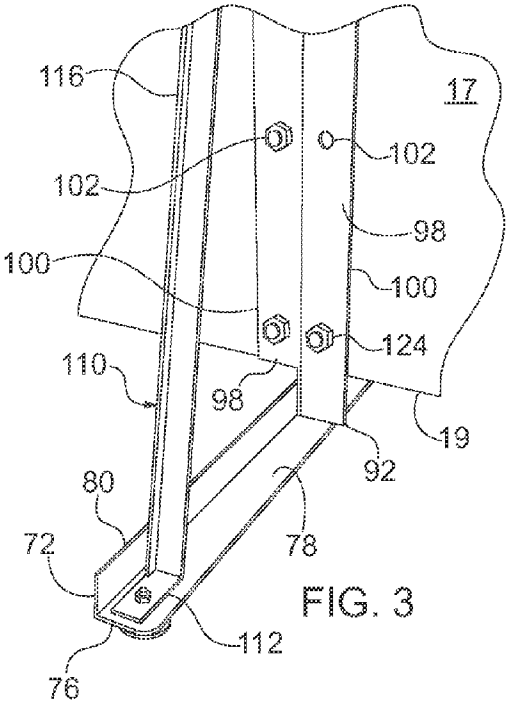
FIG. 3 illustrates a partial rear perspective view of a base portion of an intermediate member of the free-standing continuous wall assembly of FIGS. 1-2.

The base portion 72 may have any cross-section in a plane normal to a length thereof including, without limitations, solid, closed hollow by being manufactured from a tubular material or partially open, for example such as U-shape or L-shape of FIGS. 3 and 5. The exemplary base portion 72 has a pair of flanges, a horizontally disposed flange, referenced with a numeral 78 and a vertically disposed flange, referenced with a numeral 80, defining, in a combination with each other, the above referenced L-shaped cross-section.

The upright portion 90 has a bottom end 92 being connected to the vertically disposed flange 80 of the base portion 72. Such bottom end 92 may be connected in a permanent manner, for example such as by welding, or in a releaseable manner, for example such as by fastening. When the connection is by way of fastening, the bottom end 92 is adapted with one or more apertures 94 and the flange 80 is adapted with one or more apertures 82 being aligned with one or more apertures 94. The longitudinally opposite end 96 of the upright portion 90 may be provided as a free end. The upright portion 90 may also have a pair of flanges 98, each with two or more holes 102 formed through a thickness of each flange 98, adjacent and along each vertical edge 100 thereof, in a complimentary alignment with the holes 16 in a respective panel 12. The pair of flanges 98 may depend from a single upright portion 90. The pair of flanges 98 may be provided as separate members, with the upright portion 90 being defined by a pair of separate members joined together prior to assembly so as to form a one-piece member.

The flanges 98 do not have to be continuous along the length of the upright portion 90. By way of an example only, the upright portion 90 may be provided as a tubular member (not shown) and the flanges 98 may be defined by a plurality of tabs extending in opposite directions from an exterior surface of such tubular member and adapted with such hole 102.

A front edge surface 104 of the upright portion 90 of each intermediate member 70 may protrude forward the front surface 14 of each panel 12.

Each brace 110 defines a pair of ends 112, 114 and a main portion 116 disposed between the pair of ends 112, 114. The main portion 116 may have, by way of one example only, an L-shaped cross-section in a plane transverse to a length thereof.

Each brace 60 defines a pair of ends 112, 114 and a main portion 116 disposed between the pair of ends 112, 114. The main portion 116 may have, by way of one example only, an L-shaped cross-section in a plane transverse to a length thereof. One or both ends 112 and 114 may be flattened, each defining a pair of planar surfaces. When one or both ends 112 and 114 are flattened, each of the pair of flattened ends 112, 114 is inclined at an angle relative to the main portion 116. The brace 110 may be permanently or releaseably attached to the base portion 72 and upright portion 90 meaning that one end of the brace 110, referenced with numeral 112, is connected permanently or releaseably, for example by fastening, during use, to the horizontally disposed flange 78 and that the opposite end 114 of the brace is connected, permanently or releaseably, for example by fastening, to the upright portion 90.

When the brace 110 is adapted for a releaseable attachment, such attachment may be by way of fastening, wherein each of the pair of flattened ends 112, 114 has one or more apertures 118 formed through a thickness thereof and wherein complimentary apertures are provided in the base portion 72 and the upright portion 90 essentially in an identical manner as in the attachment of the above described brace 60.

The length of the brace 110 may be so selected that aperture 118 in the end 114 is aligned with the above described holes 16 and 102.

The opposite end 114 may be connected at a distance from the base portion 72 of between forty and sixty percent of a length of the upright portion 90, particular when the panel 12 is provided having a width of about four (4) feet) and a length of about eight (8) feet oriented in a vertical direction.

In one example, the front end of the base portion 72, referenced with numeral 74, may protrude forward the front surface 14 of each panel 12 at a smaller distance than a front end 24 of the base portion 22 of the respective end member 20. Such smaller distance may be less than three (3) inches or less than six (6) inches, while the front end 24 of the base portion 22 may protrude at a distance of about twelve (12) inches.

The rear end of the base portion 72, referenced with numeral 76 and the rear end of the base portion 22, referenced with numeral 26 may protrude at equal or different distanced from the rear surface 17 of the panel 12.

When the connections are by way of fastening, the free-standing wall 10 includes pluralities of fasteners 120 at least passed through respectively aligned apertures in each panel 12, two end members 20 and one or more intermediate members 70 or two intermediate members 70 and fastening each panel 12 directly thereto. The fasteners 120 may be of any type that allow for releaseable attachment, for example such as bolts 122 and nuts 124.

The bottom edge 19 of each panel 12 may be spaced a distance from a surface (not shown) having the base portions 22 and 72 supported thereon. Any such distance is contemplated in this exemplary embodiment as long as the bottom edge 19 is not resting on the surface (not shown).

Figure 2:
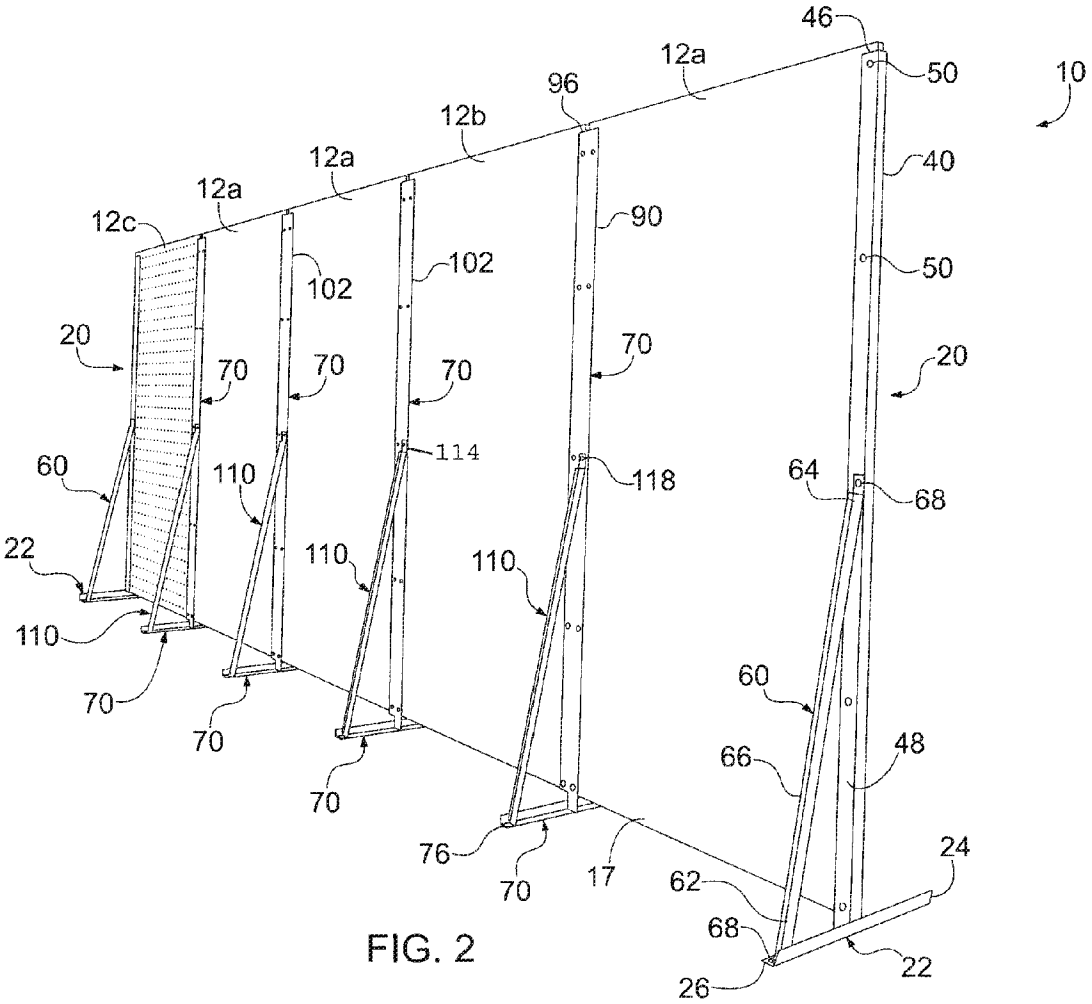
FIG. 2 illustrates an exemplary rear perspective view of the free-standing continuous wall assembly of FIG. 1.
Figure 6:
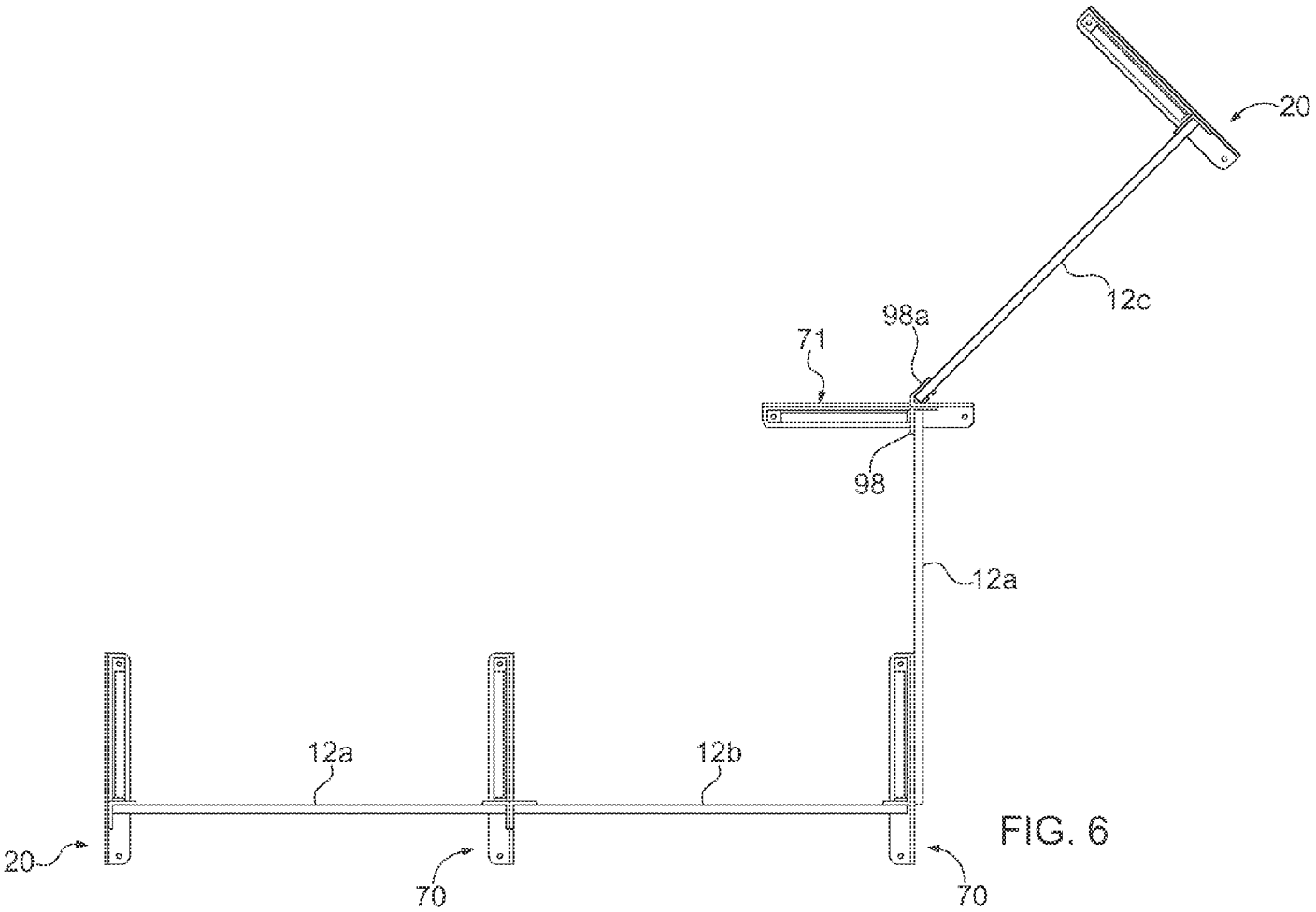
FIG. 6 illustrates an exemplary top view of a different form of the free-standing continuous wall assembly of FIGS. 1-2.

The free-standing wall assembly 10 may be so assembled and arranged that the plurality of panels 12 are disposed planar with each other to form a wall assembly that continuous in one plane, as is best illustrated in FIGS. 1-2. The free-standing continuous wall assembly 10 may be also assembled and arranged so that at least two of the plurality of panels 12 are disposed relative to each other at angles less than ninety (90) degrees or one hundred eighty (180) degrees, as is best illustrated in FIG. 6. Such free-standing wall assembly 10 of FIG. 6 continues in more than one plane. When any panel is disposed at an angle less than ninety degrees, the free-standing continuous wall assembly 10 includes an intermediate upright 71 that includes at least one flange 98 disposed at such corresponding angle. In other words, one flange 98 may be inclined at an angle less than ninety degrees to the other flange.

In one exemplary embodiment, the free-standing wall assembly 10 may be configured and provided without any braces spanning the width of the panels 12 and being connected at each end to the bases 22 and/or 72 and/or connecting upper free ends of the upright portions 40 and 90.

In another exemplary embodiment, the free-standing wall assembly 10 may be configured and provided without any visible or noticeable gaps between a pair of adjacent panels 12 which may be advantageous in applications such as tradeshows. In other words, as is best illustrated in FIGS. 3-5, the vertically disposed edge of each panel 12 either abuts the surface of the corresponding upright portion or disclosed in a very close proximity thereto with the gap being any one of 0.125 inches, 0.25 inches, 0.38 inches, 0.500 inches, 0.63 inches, 0.75 inches, 0.88 inches and 1.00 inch. In some exemplary embodiments, the continuous flange of the upright portion prevents the light to pass through such gap.

In some exemplary embodiments, the panel 12 may be composed of two or more sub-panels joined to a single upright portion or the upright portion may be provided in sections joined by a backing member (not shown).

In either exemplary embodiment, each panel 12 is prevented from tilting in a forward or a rearward direction when weight of up to two thousand (2,000) pounds is attached to the front surface 14 thereof. The weight is defined by all objects (not shown) hung from or attached to the panel 12 by various conventional accessories (not shown).

In either exemplary embodiment, a long edge of each panel 12 may be disposed either vertically or horizontally.

In another exemplary embodiment, the base portion of each intermediate member 70 protrudes forward the front surface 14 of the panel 12 less than the respective base portion of the end member 40, so as to minimize interference with a person attaching to ore removing objects from the front surface 14 of the panel 12.

In some exemplary embodiments, the front and rear surfaces of the panel 12 may be provided as working surfaces, in a double-sided arrangement, allowing, for example, attachment of objects (not shown) from the front and rear of the free-standing continuous wall assembly 10.

In either exemplary embodiment, the free-standing continuous wall assembly 10 may be composed of panels of different types. As is best exemplary illustrated in FIGS. 1 and 6, such free-standing continuous wall assembly 10 comprises slat panels 12*a*, a peg board 12*b*, and a panel 12*c* that can have a dry-erase, a magnetic surface or any other continuous surface.

In either exemplary embodiment, the panel 12 is provided without any horizontal and/or vertical bracing members disposed between the vertical edges thereof on either the front or rear surface of the panel 12.

In either exemplary embodiment, the panel 12 is supported only at vertical side edges thereof by the end and/or intermediate members.

In one exemplary embodiment, the free-standing continuous wall assembly 10 has each panel 12 being only supported by the two end upright members 20 and one or more intermediate upright members 70, wherein a bottom edge of each panel 12 is spaced from a surface having 10 free-standing continuous wall assembly 10 upstanding on.

Figure 7:
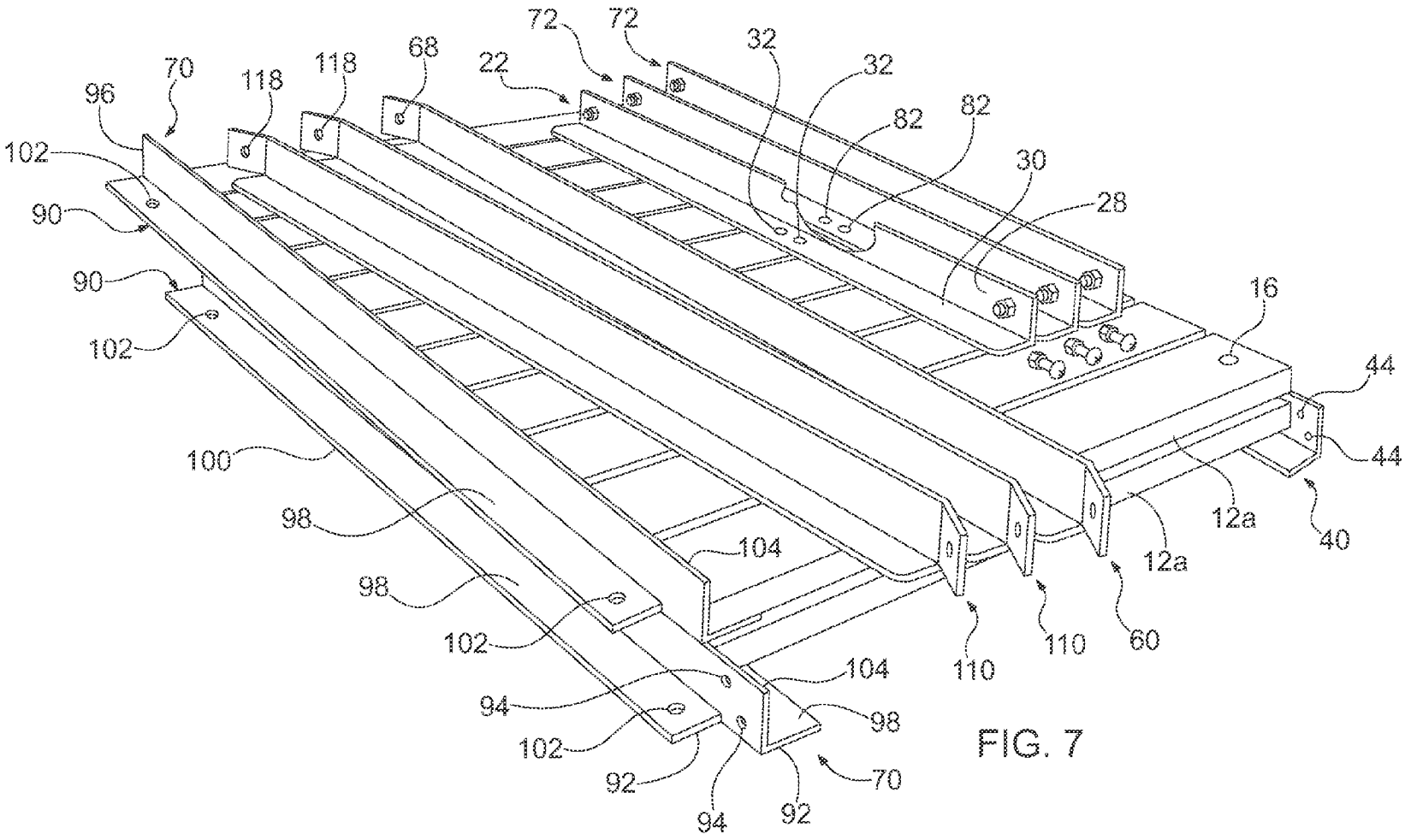
FIG. 7 illustrates an exemplary perspective view of several panels of the free-standing continuous wall assembly of FIGS. 1-2 in a position for storage and/or transport.

FIG. 7 illustrates two panels 12*c* of the free-standing continuous wall assembly 10 of FIGS. 1-2 in a position for storage and/or transport. The two panels 12*c* are stacked in a vertical direction. Any additional panels 12 will be further stacked in the vertical direction. The base portions 22, 72 and braces 60 and 110 may be positioned on the exposed surface of the upper most panel 12. When the free-standing continuous wall assembly 10 is disassembled for storage and/or transport purposes, one end member 20 or one intermediate member may 70 remain attached to a respective panel 12. Then, during subsequent re-assembly of the free-standing continuous wall assembly 10 at a different location, only an opposite end of most panels 12 has to be fastened to either the end member 20 or the intermediate member 70. Furthermore, when neither the end member 20 nor the intermediate members 70 have to be disassembled when provided as including fastened components, such arrangement reduces the cost of assembly/disassembly effort and further enhances an economical method of manufacturing and providing the free-standing continuous wall assembly 10.

To assemble the free-standing continuous wall assembly 10, the upright portion is attached to the base portion and the brace is attached to both upright portion and the base portion. This is repeated for all end and intermediate members. Each panel is then attached to the end and/or intermediate members to define the free-standing continuous wall assembly 10. It is also contemplated that the brace can be attached after attachment of the panel, particularly when upper end of the brace utilizes a common connection between the panel and the upright portion. It is further contemplated that the end and/or intermediate members may be partially or fully pre-assembled and even attached to one edge of the panel, as is best shown in FIG. 7.

When the free-standing continuous wall assembly 10 is upright, the objects are hung or attached to each panel either directly, as in an example of a dry-erase board type panel, or by conventional accessories to peg board and slatwall type panels.

Dis-assembly of the free-standing continuous wall assembly 10 for transport and/or storage purposes follows the reversed procedure.

The chosen exemplary embodiments of the claimed invention have been described and illustrated for practical purposes so as to enable any person skilled in the art to which it pertains to make and use the same. It is therefore intended that all matters in the foregoing description and shown in the accompanying drawings be interpreted as illustrative and not in a limiting sense. It will be understood that variations, modifications, equivalents and substitutions for components of the specifically described exemplary embodiments of the invention may be made by those skilled in the art without departing from the spirit and scope of the invention as set forth in the appended claims.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is no intended to invoke the provision of 35 U.S.C. §112, ¶6.

Furthermore, the Abstract is not intended to be limiting as to the scope of the claimed invention and is for the purpose of quickly determining the nature of the claimed invention.

What is claimed is:

1. A free-standing continuous wall assembly comprising:

a plurality of panels, each panel having holes formed through a thickness thereof and disposed in a linear pattern adjacent each vertical edge of said each panel, a bottom edge of said each panel is spaced a distance from a surface having said free-standing continuous wall assembly supported thereon, said each panel is prevented from tilting in a forward or a rearward direction when weight is attached to a front surface thereof;

two end members, each end member including a base portion, an upright portion upstanding on said base portion mediate ends thereof and a brace having one end connected to said base portion and having an opposite end thereof connected to said upright portion at a distance from said base portion of between forty and sixty percent of a length of said upright portion, said upright portion having a flange with a hole pattern formed through a thickness thereof in a complimentary alignment with said hole pattern in said each panel;

one or more intermediate members, each intermediate member including a base portion, an upright portion upstanding on said base portion of said each intermediate member and a brace having one end connected to said base portion of said each intermediate member and having an opposite end thereof connected to said upright portion of said each intermediate member at a distance from said base portion of said each intermediate member of between about fifty and about seventy percent of a length of said upright portion of said each intermediate member, said upright portion of said each intermediate member having a pair of flanges having a front edge surface thereof protruding forward said front surface of said each panel, each of said pair of flanges having a hole pattern formed through a thickness of said each of said pair of flanges of said upright portion of said each intermediate member adjacent and along each vertical edge thereof in said complimentary alignment with said hole pattern in said each panel, said base portion of said each intermediate member having a front end thereof protruding forward said front surface of said each panel at a smaller distance than a front end of a base portion of a respective end member; and fasteners at least passed through aligned apertures in said each panel and one of said two end members and one intermediate member or two intermediate members and fastening said each panel directly thereto.

2. The free-standing continuous wall assembly of claim 1, wherein two or more of said plurality of panels are disposed relative to each other at angles less than 180 degrees.

3. The free-standing continuous wall assembly of claim 1, wherein said plurality of panels are disposed planar with each other.

4. The free-standing continuous wall assembly of claim 1, wherein said each of said plurality of panels defines a sheet having a uniform thickness throughout except for portions thereof occupied by one of apertures, channels, grooves and combinations thereof.

5. The free-standing continuous wall assembly of claim 1, wherein said each of said plurality of panels defines a one-piece sheet being sufficiently flexible to develop a concave shape when being supported in a horizontal plane at a pair of opposite edges thereof.

6. The free-standing continuous wall assembly of claim 1, wherein said each of said plurality of panels is one of a peg board, slat board, chalk board, magnetic board, and dry-erase board.

7. The free-standing continuous wall assembly of claim 1, wherein rear ends of each base portion are disposed at an equal distance from a rear surface of said each panel.

8. The free-standing continuous wall assembly of claim 1, wherein each base portion has a pair of flanges defining an L-shaped cross-section of said each base portion in a plane transverse to a length thereof, wherein said one end of each brace is fastened, during use, to a horizontally disposed flange and wherein a bottom end of each upright portion is fastened to a vertically disposed flange.

9. The free-standing continuous wall assembly of claim 1, wherein each brace defines a pair of flattened ends and a main portion disposed between said pair of flattened ends and having an L-shaped cross-section in a plane transverse to a length thereof, wherein each of said pair of flattened ends is inclined at an angle relative to said middle portion and wherein said each of said pair of flattened ends has one or more apertures formed through a thickness thereof.

10. The free-standing continuous wall assembly of claim 1, wherein one of said pair of flanges of said upright portion of said intermediate member is inclined at an angle less than ninety degrees to an opposite one of said pair of flanges of said upright portion of said intermediate member.

11. The free-standing continuous wall assembly of claim 1, wherein said opposite end of said brace of said each intermediate member is connected to said upright portion thereof at a connection of said upright portion of said each intermediate member with a respective panel.

12. A free-standing continuous wall assembly comprising:

two end upright members, each having a base portion, an upright portion upstanding on said base portion and a brace connecting said upright portion with said base portion;

one or more intermediate upright members, each having a base portion, an upright portion upstanding on said base portion of said one or more intermediate upright members, and a brace connecting said upright portion of said one or more intermediate upright members with said base portion of said one or more intermediate upright members;

a plurality of panels disposed in a vertical plane, each panel defining a one-piece sheet being sufficiently flexible to develop a concave shape when being supported in a horizontal plane at a pair of opposite edges thereof; and whereby fasteners only fastening vertical side edges of said each panel directly to one of said two end upright members and one intermediate upright member or directly to two intermediate upright members, prevent, in a combination with said two end upright members and said one or more intermediate upright members, said each panel from developing said concave shape and from tilting in a forward or a rearward direction when weight is attached to a front surface thereof.

13. The free-standing continuous wall assembly of claim 12, wherein a bottom edge of said each panel is spaced from a surface having said free-standing continuous wall assembly upstanding on.

14. The free-standing continuous wall assembly of claim 12, wherein upper ends of said two end upright members and said one or more intermediate upright members are not connected by horizontal cross-member(s).

15. The free-standing continuous wall assembly of claim 12, wherein said fasteners include apertures and threaded fasteners.

16. The free-standing continuous wall assembly of claim 12, wherein said each panel is only supported by said two end upright members and said one or more intermediate upright members.

17. The free-standing continuous wall assembly of claim 12, wherein said each panel is only supported by said two end upright members and said one or more intermediate upright members and wherein a bottom edge of said each panel is spaced from a surface having said free-standing continuous wall assembly upstanding on.

18. A free-standing continuous wall assembly comprising:

a plurality of flexible sheets disposed in a vertical plane, each flexible sheet comprising holes formed through a thickness thereof and disposed in a linear pattern adjacent each vertical edge of said each flexible sheet;

two end upright members, each being configured for a resting and upstanding on a surface and comprising a pair of flanges defining an L-shaped cross-section in a plane normal to a length of said each end upright member, one of said pair of flanges comprising a hole pattern formed through a thickness thereof in a complimentary alignment with said hole pattern in said each flexible sheet;

one or more intermediate upright members, each being configured for resting and upstanding on the surface and comprising a pair of flanges defining an T-shaped cross-section in a plane normal to a length of said each intermediate upright member, each of said pair of flanges comprising holes being formed in a linear pattern through a thickness thereof, said holes being in a complimentary alignment with respective holes in said each flexible sheet; and whereby threaded fasteners only fastening, through aligned holes, vertical side edges of each flexible sheet directly to one of said two end upright members and one intermediate upright member or directly to two intermediate upright members and prevent, in a combination with said two end upright members and said one or more intermediate upright members.

* * * * *